US009435135B1

(12) United States Patent
Hinds

(10) Patent No.: US 9,435,135 B1
(45) Date of Patent: Sep. 6, 2016

(54) ADJUSTABLE FENCE SYSTEMS

(71) Applicant: Clive Hinds, Bethlehem, PA (US)

(72) Inventor: Clive Hinds, Bethlehem, PA (US)

( * ) Notice: Subject to any disclaimer, the term of this patent is extended or adjusted under 35 U.S.C. 154(b) by 9 days.

(21) Appl. No.: 14/337,104

(22) Filed: Jul. 21, 2014

Related U.S. Application Data

(60) Provisional application No. 61/875,605, filed on Sep. 9, 2013.

(51) Int. Cl.
*E04H 17/16* (2006.01)
*E04H 17/20* (2006.01)
*E04H 17/00* (2006.01)

(52) U.S. Cl.
CPC ..... *E04H 17/16* (2013.01); *E04H 17/20* (2013.01); *E04H 2017/006* (2013.01)

(58) Field of Classification Search
CPC ..... E01F 13/04; E01F 13/044; E01F 13/046; E01F 13/048; E04H 17/168; E06B 3/44; E06B 3/4407; E06B 3/4423
See application file for complete search history.

(56) References Cited

U.S. PATENT DOCUMENTS 911,318 A * 2/1909 Mix ..... E06B 3/44 292/77
1,530,056 A * 3/1925 Pace ..... B61L 29/02 49/257
3,713,625 A * 1/1973 Trudell ..... E04H 17/06 256/32
4,576,507 A * 3/1986 Terio ..... E01F 13/046 404/6
5,271,183 A * 12/1993 Hahn ..... E01F 13/048 49/103
5,332,196 A * 7/1994 Wright ..... E04H 17/06 116/173
5,577,710 A 11/1996 Kirby
5,661,946 A 9/1997 Davis
5,709,057 A * 1/1998 Johnson, Jr. ..... G09F 7/18 248/219.2
6,772,998 B2 8/2004 Bebendorf
7,329,067 B1 * 2/2008 Rodriguez ..... E01F 13/046 256/13.1
8,844,907 B1 * 9/2014 Davis ..... E04H 17/20 256/1
2003/0192253 A1 * 10/2003 Miller ..... E01F 13/046 49/49
2005/0183385 A1 * 8/2005 Ohanesian ..... B28B 7/0073 52/782.1
2005/0230194 A1 * 10/2005 Nakamura ..... B66B 5/0081 187/401
2007/0068078 A1 * 3/2007 Hosokawa ..... E01F 13/046 49/49
2007/0158629 A1 * 7/2007 Laws ..... E04H 17/168 256/24
2010/0243975 A1 * 9/2010 Stover ..... E04H 17/24 256/1

FOREIGN PATENT DOCUMENTS

DE 29621995 U1 * 2/1997 ..... E01F 13/048
KR WO 2012118273 A2 * 9/2012 ..... B61B 1/02

* cited by examiner

*Primary Examiner* — Jonathan Masinick
(74) *Attorney, Agent, or Firm* — Miller Law Group, PLLC

(57) ABSTRACT

A privacy fence includes a lower base portion and a telescopically extendable upper portion that is vertically movable relative to the lower base portion to provide a privacy fence that has a selectively adjustable height. The lower base portion is formed of a panel section extending between two spaced apart posts. The upper telescopic portion also includes a panel member extending between two post members wherein the panel member is received within the interior of the base panel portion and the two post members are received within the posts and connected to an actuation mechanism. As desired, the actuation mechanism can be operated to move the post members vertically, which in turn raises the panel member telescopically out of the base panel portion. Optional flower pots can be mounted on top of the post members to be movable therewith, or to provide flower pots on conventional fence posts.

18 Claims, 5 Drawing Sheets

ADJUSTABLE FENCE SYSTEMS

CROSS-REFERENCE TO RELATED APPLICATION

The present application is related to and claims priority from prior provisional application Ser. No. 61/875,605, filed Sep. 9, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of fencing and more specifically relates to an adjustable sectional privacy fence system for modular use.

2. Description of the Related Art

Modernly many people live in houses on property. "Good fences make good neighbors," observed the poet Robert Frost; and although he was speaking of the New Hampshire stone walls that separated his land from that of his neighbor, the fact is that since his time, America has become a nation of fences with good neighbors. In cities and suburbs across the country, fences often define our household boundaries, and fences separate us, our pets and our properties, one from another.

Fences establish a perimeter to our properties, enclosing what we own and value within a solid barrier, blocking entry to those who might covet our possessions or threaten us with harm. Fences provide a 'visual curtain' as well, ensuring that even in a densely populated urban or suburban setting, we can enjoy a measure of personal or familial seclusion on our own parcel of earth. There is no doubt that a privacy fence is a great means of keeping your neighbor from minding your business and protecting your property. The trouble with a privacy fence is that view may be compromised for the occupants who from time to time might prefer to adjust, and enjoy a longer view that may be realized from a lower fence. A fence system that allows for adjustability is desirable.

Various attempts have been made to solve the above-mentioned problems such as those found in U.S. Pat. No. 5,661,946 to Kenneth Davis; U.S. Pat. No. 5,577,710 to George T. Kirby; and U.S. Pat. No. 6,772,998 to Ronald William Bebendorf. This art is representative of fences. None of the above inventions and patents, taken either singly or in combination, is seen to describe the invention as claimed.

Ideally, an adjustable sectional privacy fence system should provide privacy when desired and efficiency in use and, yet would operate reliably and be manufactured at a modest expense. Thus, a need exists for a reliable adjustable sectional privacy fence system to avoid the above-mentioned problems.

BRIEF SUMMARY OF THE INVENTION

In view of the foregoing disadvantages inherent in the known fencing products art, the present invention provides a novel adjustable sectional privacy fence system. The general purpose of the present invention, which will be described subsequently in greater detail is to provide a novel sectional privacy fence that may be easily raised or lowered in height according to circumstances and the desire of the owner. At full height, the adjustable fence ensures a home-owner's privacy; and when a lower position a lower level of privacy and a wider view is achieved; the adjustable fence may be quickly and easily lowered to achieve this effect.

An adjustable sectional privacy fence system is disclosed herein, in a preferred embodiment, comprising: a plurality of adjustable sectional privacy fence assemblies; each of the adjustable sectional privacy fence assemblies comprising: at least one post; at least one post-cap; and at least one panel-section; a powerer; a remote controller; and a mechanical adjusting assembly; wherein the adjustable sectional privacy fence system comprises the plurality of adjustable sectional privacy fence assemblies, the powerer, the remote controller, and the mechanical adjusting assembly in functional combination.

Each of the adjustable sectional privacy fence assemblies comprises the at least one post, the at least one post-cap, and the at least one panel-section. The post-cap is able to be installed in a top of the post to upwardly enclose an interior volume of the post (some may be integral.) The at least one panel-section is able to move in relation to the at least one post (up and down) via the mechanical adjusting assembly as powered by the powerer; the powerer controllable by the remote controller. Some embodiments may be telescopic and move in relation to the next telescopic section. Certain alternate embodiments may allow horizontal travel. The adjustable sectional privacy fence system comprises a modular fencing system which is handy for use on a variety of surface contours and terrains.

The mechanical adjusting assembly is in communication with the powerer (electrical source or the like.) The at least one post preferably comprises at least one track located on an external surface of the at least one post to enable smooth operation of the mechanical adjusting assembly. Alternate embodiments may have one post on either side of the panel-section. Some versions may be connected post to post adjacently to form the modular connection(s). Other embodiments comprise connections modularly able to be made wherein a post-panel-section to an adjacent post-panel-section connection is enabled. The various versions may be used together to form the desired perimeter (corners, straight-sections, etc.).

Each of the adjustable sectional privacy fence assemblies may comprise a pin-and-hole detent means for adjusting and locking the at least one post in relation to the at least one panel-section, the pin-and-hole detent means able to be repeatedly locked and unlocked to limit and unlimit travel respectively as determined by a user to attain the user-preferred privacy level. Other suitably equivalent moving means, manipulating means and locking/unlocking means may be used. The at least one panel-section preferably comprises vinyl to provide a colored esthetic (fit and) finish and protection from environmental degradation (corrosion or the like.)

Each of the adjustable sectional privacy fence assemblies are able to be independently manipulated through ten feet of travel (four to ten feet in preferred embodiments). As such, the "travel" comprises a range from an upper position to a lower position; wherein the lower position provides maximum visual exposure and minimum privacy and the upper position provides minimum visual exposure and maximum privacy. In vertically moveable versions the travel is vertically orientated along the at least one post (adjacent the vertically at least one panel-section.) Travel in telescopic version is relative between adjacent sections.

Preferred embodiments of the mechanical adjusting assembly may comprise a chain and sprocket system, pulley/cable or chain systems or the like. Hydraulic, pneumatic, mechanical, electrical means for manipulation via mechanical adjusting assembly may be used to create substantially equivalent results. The post preferably comprises a square cross-section; however other cross-sections may be used. The adjustable sectional privacy fence system is structured and arranged such that adjustment is available to a user-preferred privacy level as controlled by the user.

A kit is also disclosed including: the plurality of adjustable sectional privacy fence assemblies; the powerer; the mechanical adjusting assembly; the remote controller; and a set of user installation instructions.

A method of using an adjustable sectional privacy fence system is described herein comprising the steps of: installing a set of adjustable sectional privacy fence assemblies in relation to a ground surface according to a ground-surface-contour; manipulating at least one panel-section in relation to at least one post to create a user-preferred privacy level as controlled by a user; and independently adjusting the adjustable sectional privacy fence assemblies in relation to an adjoining section as desired. Telescoping may provide adjustment.

The present invention holds significant improvements and serves as an adjustable sectional privacy fence system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, adjustable sectional privacy fence system, constructed and operative according to the teachings of the present invention.

The various embodiments of the present invention will hereinafter be described in conjunction with the appended drawings, wherein like designations denote like elements.

DETAILED DESCRIPTION

Figure 1:
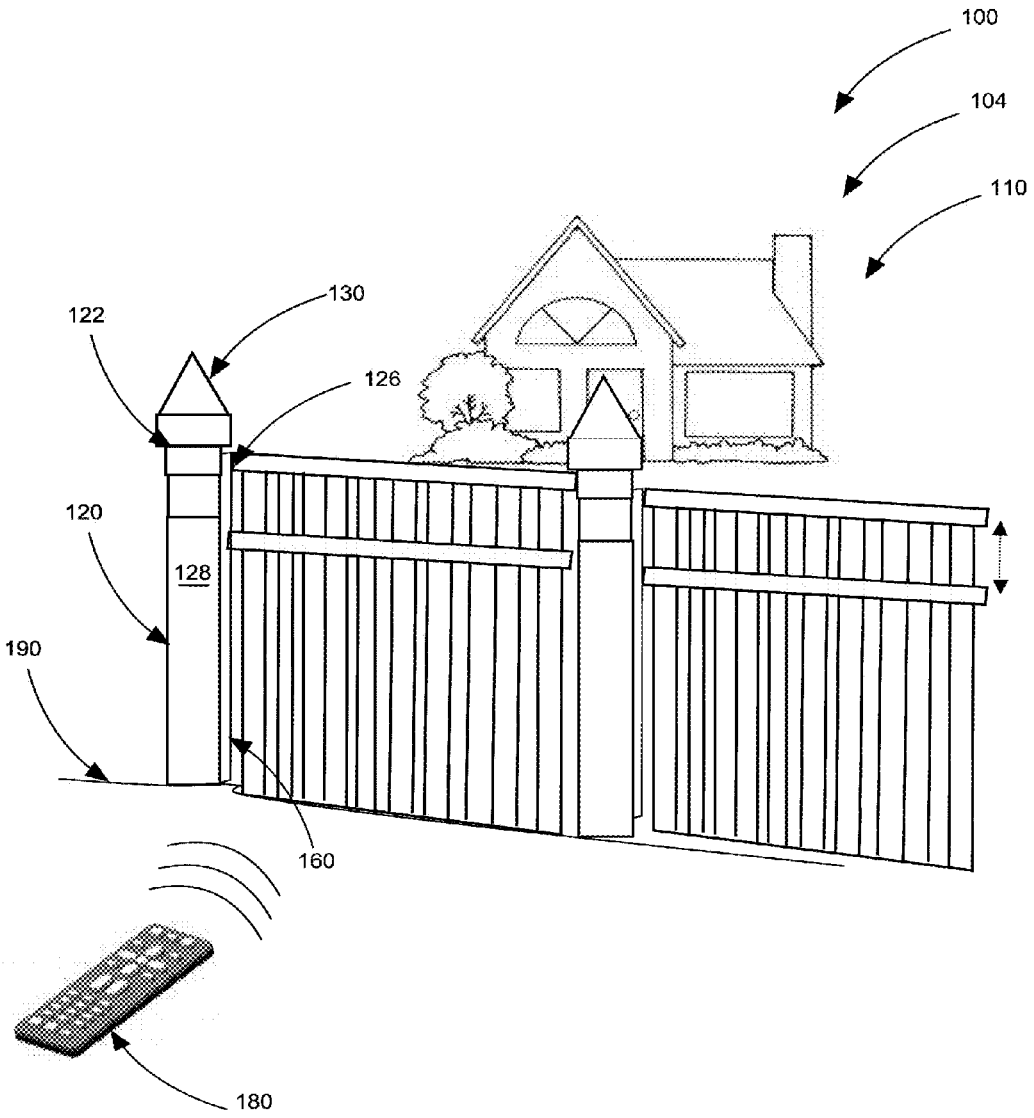
FIG. 1 shows a perspective view illustrating an adjustable sectional privacy fence system as to be assembled according to an embodiment of the present invention.

As discussed above, embodiments of the present invention relate to a fencing product and more particularly to an adjustable sectional privacy fence system as used to improve the efficiency and effectiveness of fences.

Generally speaking, the adjustable sectional privacy fence system as disclosed herein is used to improve the adjustability of fencing via modular means. The adjustable fence may be a vinyl or vinyl-clad sectional privacy fence, preferably fabricated and sold in 6-foot, ready-to-install sections, featuring a unique, retractably elevating design which permits the fence height to be altered easily and repeatedly. The adjustable fence, in superficial appearance, may closely resemble other high-quality vinyl or vinyl-clad galvanized privacy fencing, with squared posts, pyramidal post-caps, and intermediate sections of continuous, vertically oriented slat-style panels. Like other privacy fencing, the adjustable fence may be produced in several alternative designs with round posts and scalloped panels, or a woven-rail appearance, for example. As noted, the adjustable fence may be produced in modular, 6-foot sections comprising either of a mid-post and two panels, or a single panel and two end-posts. The sections may molded and pre-fitted to join and lock together, and virtually any property line or slope profile may be accommodated.

Unlike other vinyl or vinyl-clad privacy fencing, the adjustable fence design permits the height of the fence to be varied. This is accomplished by an extendable, retractable design in which the standard 6-foot fence-posts and panels conceal within their interior another, slightly thinner set of posts and panels that may be raised on a sliding track-and-channel mechanism to extend upward, adding height to the fixed fence and appearing continuous with it. The system might for example employ a pin-and-hole, variable-height locking system that may be operated manually, section-by-section, by the homeowner; or a motorized, chain-and-sprocket system, electrically powered and operated by a wired or wireless switch or remote-control, that may raise and lower multiple sections of the fence simultaneously. In either case, the extending sections of the Adjustable Fence may be continuous with the fixed sections, and the slot through which the interior posts and panels rise may be sealed with a flexible, two-sided rubber gasket. Various adjusting means may be used.

The adjustable fence may be raised and extended from a fixed height of 6 feet to a maximum height of 8 to 10 feet, thus offering the homeowner a significant choice in the level of privacy, or the expansiveness of view, afforded by the fence. This adaptability may be ideal for those who, for example, wish to enjoy a more expansive view of their surroundings during the day, yet desire a high level of visual privacy at night. The adjustable fence may be ideal for households with swimming pools or spas; and the height-adjustable design might also appeal strongly to a variety of commercial and institutional enterprises and establishments.

Figure 2:
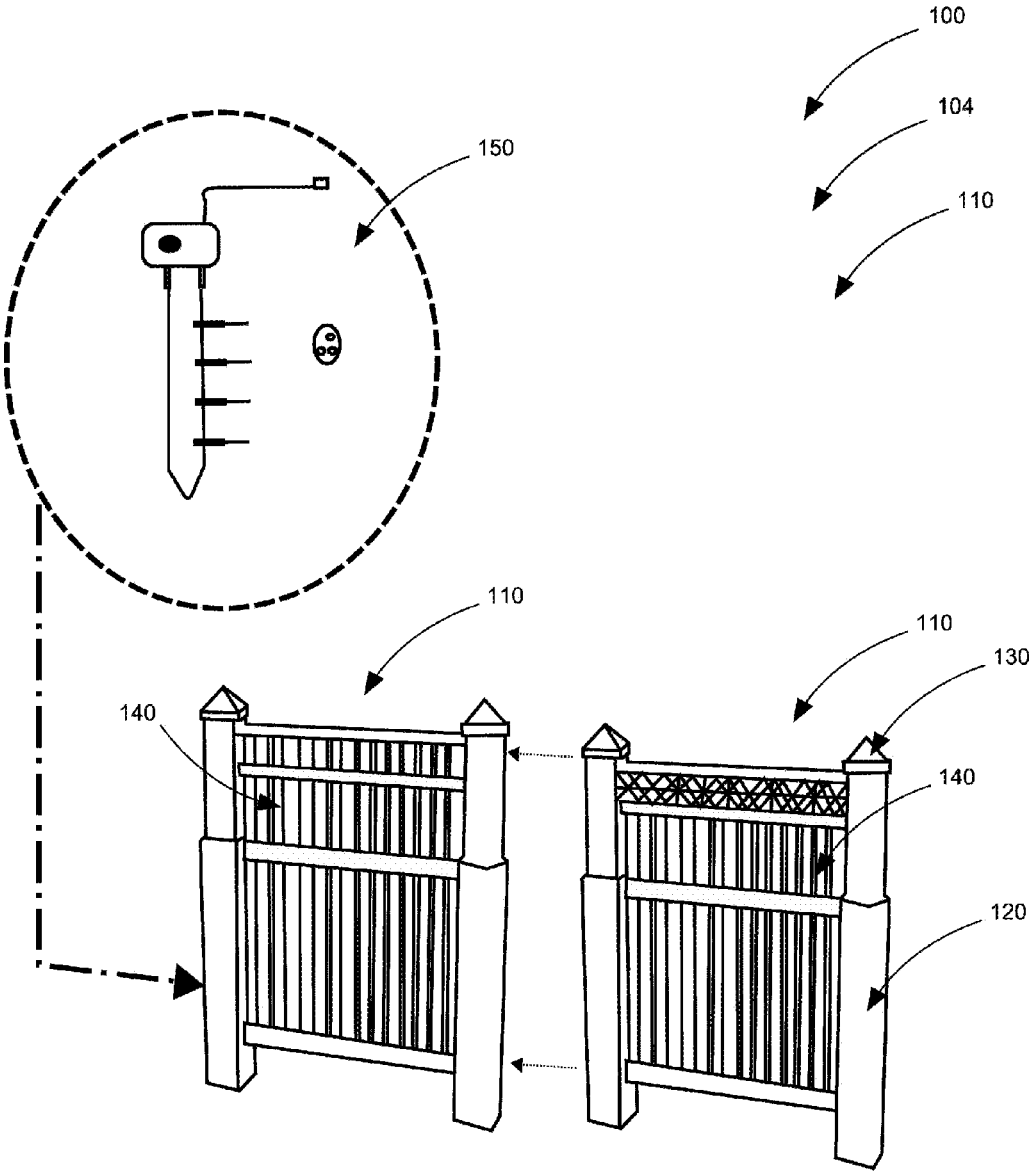
FIG. 2 is a perspective view illustrating an adjustable sectional privacy fence assembly of the adjustable sectional privacy fence system according to an embodiment of the present invention of FIG. 1.
Figure 3:
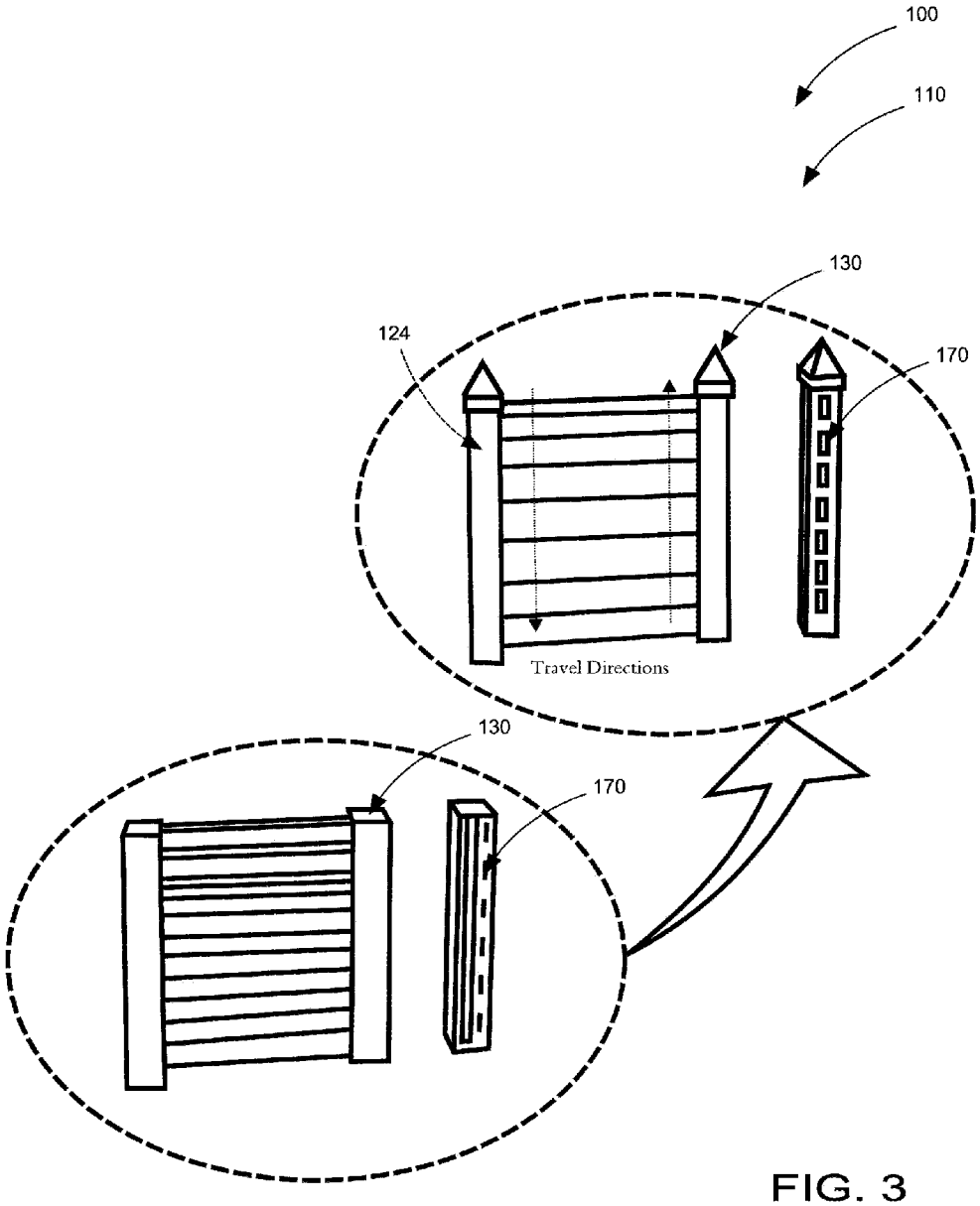
FIG. 3 is a perspective view illustrating the adjustable sectional privacy fence assembly of the adjustable sectional privacy fence system according to an embodiment of the present invention of FIG. 1.
Figure 4:
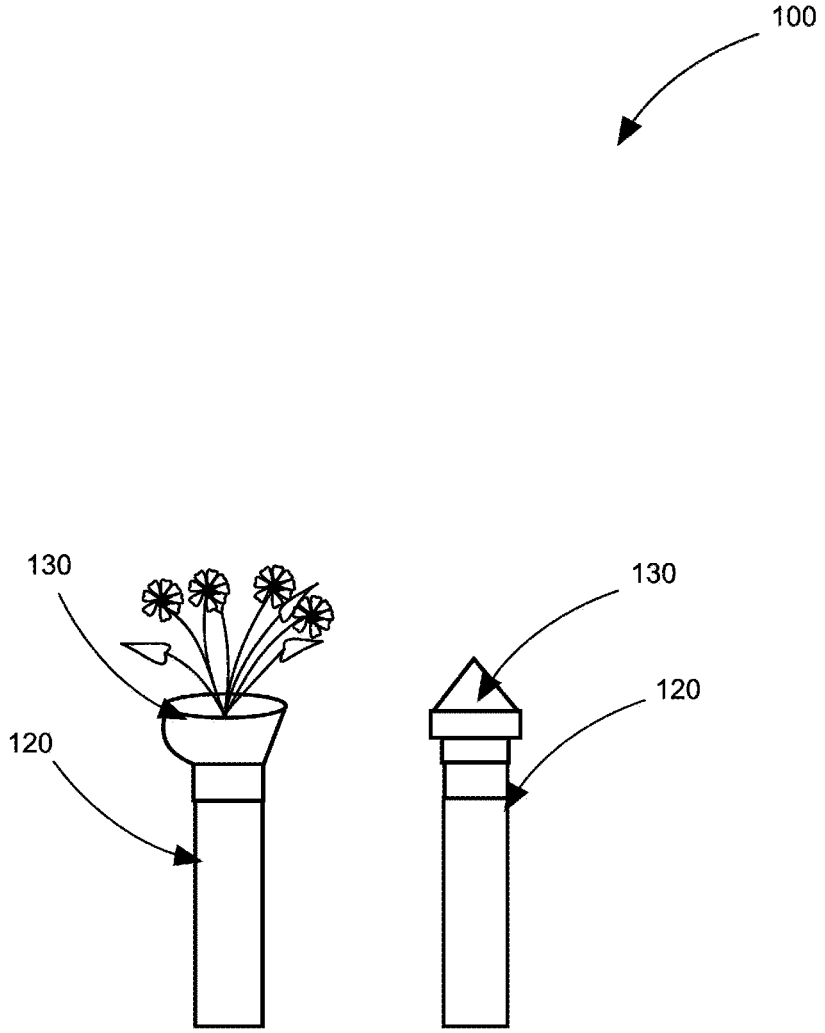
FIG. 4 is a perspective view illustrating versions of tops of the adjustable sectional privacy fence assembly of the adjustable sectional privacy fence system according to an embodiment of the present invention of FIG. 1.
Figure 5:
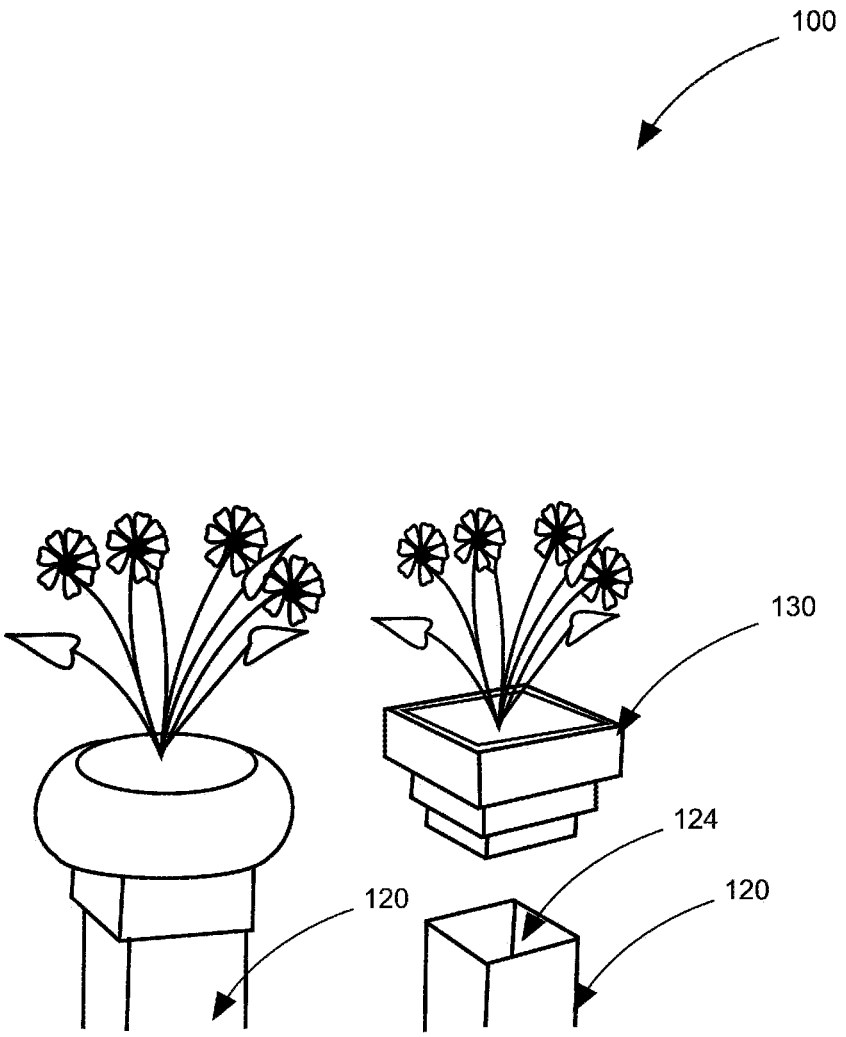
FIG. 5 is a close up perspective view illustrating the various tops of the adjustable sectional privacy fence assembly of the adjustable sectional privacy fence system according to an embodiment of the present invention of FIG. 1.

Referring now to the drawings more specifically by numerals of reference there is shown in FIGS. 1-5, various views of adjustable sectional privacy fence system 100 comprising: a plurality of adjustable sectional privacy fence assemblies 110; each of adjustable sectional privacy fence assemblies 110 comprising at least one post 120, at least one post-cap 130, and at least one panel-section 140 (may be telescopically related as shown), powerer 150, and (version of) mechanical adjusting assembly 160; wherein adjustable sectional privacy fence system 100 comprises the plurality of adjustable sectional privacy fence assemblies 110 (in adjacent communication and connection as a modular coupled apparatus/system), powerer 150, and mechanical adjusting assembly 160 in functional combination.

Each of the adjustable sectional privacy fence assemblies 110 comprises the at least one post 120, the at least one post-cap 130, the at least one panel-section 140 in connection with each other for user-friendly use. Post-cap 130 is able to be installed in a top 122 of post 120 to upwardly enclose interior volume 124 of post 120 to prevent rain and precipitation from entering therein. Relationally speaking, top 122 of post 120 is not adjacent ground surface 190.

The at least one panel-section 140 is able to move in relation to the at least one post 120 via mechanical adjusting assembly 160 as powered by powerer 150. Movement may be telescopic or linear. Mechanical adjusting assembly 160 is in communication with powerer 150. Adjustable sectional privacy fence system 100 is structured and arranged such that adjustment is available to a user-preferred privacy level as controlled by a user. Adjustable sectional privacy fence system 100 comprises modular fencing system 104 of the plurality of adjustable sectional privacy fence assemblies 110 adjacently placed for use.

Each of the adjustable sectional privacy fence assemblies 110 may comprise two post(s) 120 in certain embodiments, as previously mentioned. Regardless the version having one post 120; this version may comprise at least one track 126 located on external surface 128 of the at least one post 120 to enable relative movement of the at least one panel-section 140 via mechanical adjusting assembly 160.

At least one panel-section 140 preferably comprises vinyl to provide a colored esthetic finish and thus protection from environmental degradation (snow, rain, sunlight and the like.) Alternately, the at least one panel-section 140 comprises vinyl-cladding to envelope galvanized material; the vinyl-cladding providing colored esthetic finish and protection from environmental degradation and minimize corrosion as is the vinyl version. Upon reading this specification, it should be appreciated that, under appropriate circumstances, considering such issues as user preferences, design preference, structural requirements, marketing preferences, cost, available materials, technological advances, etc., other fencing component materials such as, for example, plastic, non-plastic, ferrous, non-ferrous, composites, etc., may be sufficient.

Each of the adjustable sectional privacy fence assemblies 110 are able to be independently manipulated through about ten feet of travel; wherein the travel is vertically orientated (and/or horizontally orientated.) In telescopic versions a range of about 3 feet per section may be traveled. Post 120 comprises a square cross-section, in certain embodiments as shown; other posts 120 may comprise a circular cross-section. Other cross-sections may be used.

The at least one panel-section 140 may comprise scallops (other profiles may be used, as those disclosed previously.) Each of the adjustable sectional privacy fence assemblies 110 may comprise pin-and-hole detent means 170 for adjusting and locking the at least one post 120 in relation to the at least one panel-section 140; pin-and-hole detent means 170 are able to be repeatedly locked and unlocked to limit and unlimit the travel respectively as determined by the user to attain the user-preferred privacy level. The travel has a range from an upper position to a lower position; wherein the lower position provides maximum visual exposure and minimum privacy and the upper position provides minimum visual exposure and maximum privacy. Various intermediate adjustments as to height may be use. Horizontally adjustable versions may comprise various intermediate adjustments. Views and privacy may be manipulated as per user-preference for example for maximum view in daylight conditions and maximum privacy in non-daylight conditions.

Mechanical adjusting assembly 160 may comprise a chain and sprocket system. Cable, pneumatic, hydraulic, electric and other equivalent means may be used to provide relative movement within the present system. Adjustable sectional privacy fence system 100 may further comprise remote controller 180. Those with ordinary skill in the art will now appreciate that upon reading this specification and by their understanding the art of movement providing means as described herein, methods of activation and use will be understood by those knowledgeable in such art.

Adjustable sectional privacy fence system 100 may be sold as a kit comprising the following parts: a plurality of adjustable sectional privacy fence assemblies 110; at least one powerer 150; at least one mechanical adjusting assembly 160; at least one remote controller 180; and a set of user installation instructions. The kit has instructions such that functional relationships are detailed in relation to the structure of the invention (such that the invention can be used, maintained, or the like in a preferred manner). Adjustable sectional privacy fence system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different panel combinations, parts may be sold separately, etc., may be sufficient.

Method of using an adjustable sectional privacy fence system 100 comprises the steps of: installing a set of adjustable sectional privacy fence assemblies 110 in relation to ground surface 190 according to a ground-surface-contour; manipulating at least one panel-section 140 in relation to at least one post 120 (or telescoping the section) to create a user-preferred privacy level as controlled by a user; and independently adjusting the adjustable sectional privacy fence assemblies 110 in relation to an adjoining section as desired.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A privacy fence for installation on a plot of real estate to restrict viewing thereof, comprising:

a plurality of base posts spaced apart by a predetermined distance, each base post defining an interior post cavity and an open post top surface;

a base panel section interconnecting each adjacent pair of base posts, such that said fence is formed by alternating base posts and base panel sections, each said base panel section defining an interior panel cavity and an open panel top surface;

a post member telescopically received within said interior post cavity of each respective said base post and being vertically movable relative to the corresponding said base post through said open post top surface, each said post member having an upper portion and a lower portion, said upper portion being located above said post top surface and said lower portion being located within said interior post cavity;

a panel member telescopically received within said interior panel cavity of each respective said base panel section and being vertically movable relative to the corresponding said base panel section through said open panel top surface, each said panel member being connected to the upper portion of the adjacent said post members such that the vertical movement of said post members will affect a corresponding vertical movement of said panel member; and an actuator mechanism positioned within each respective said interior post cavity for engagement with the lower portion of the corresponding said post member to cause selected vertical movement thereof.

2. The privacy fence of claim 1 wherein said actuator mechanism is operable to affect simultaneous vertical movement of all said post members when activated.

3. The privacy fence of claim 1 wherein said actuator mechanism includes a power source supported within the interior post cavity of a selected base post, and a cooperative actuator member positioned in the interior post cavity of the remaining base posts and connected to the lower portions of the corresponding post members, each said actuator member being operatively coupled to said power source.

4. The privacy fence of claim 3 wherein each said actuator member is an electrical actuator operatively connected to an electrical powerer to receive electrical power therefrom, said electrical powerer being operable remotely.

5. The privacy fence of claim 3 wherein each said actuator member is hydraulically coupled to said power source.

6. The privacy fence of claim 3 wherein each said actuator member is pneumatically coupled to said power source.

7. The privacy fence of claim 1 wherein said base panel section is formed of vertically oriented slats, each said slat having an interior slat cavity, each corresponding panel member being formed of slat members with each said slat member being received in the interior slat cavity of a corresponding said slat, each said slat member of each respective said panel member being connected to a horizontal support member extending between the adjacent said post members so that said slat members will be vertically movable relative to said slats.

8. The privacy fence of claim 7 wherein the slats on each said base panel section are interconnected by a pair of vertically spaced horizontal supports interconnecting the adjacent base posts to support said slats therebetween.

9. The privacy fence of claim 1 wherein at least one of said post members is capped with a flower pot.

10. The privacy fence of claim 9 wherein said flower pot is shaped to permit insertion into an open top post member surface.

11. In a privacy fence having a plurality of spaced apart posts interconnected by panel sections such that said privacy fence is formed by alternating base posts and panel sections, the improvement comprising:

each said post including:

a base post defining an interior post cavity and an open post top surface; and a post member telescopically received within said interior post cavity and being vertically movable relative to said base post through said open post top surface, each said post member having an upper portion and a lower portion, said upper portion being located above said post top surface and said lower portion being located within said interior post cavity;

each said panel section including:

a base panel section interconnecting each adjacent pair of base posts, each said panel section defining an interior panel cavity and an open panel top surface; and a panel member telescopically received within said interior panel cavity and being vertically movable relative to said base panel section through said open panel top surface, each said panel member being connected to the upper portion of the adjacent said post members such that the vertical movement of said post members will affect a corresponding vertical movement of said panel member; and an actuator mechanism positioned within each respective said interior post cavity for engagement with the lower portion of the corresponding said post member to cause selected vertical movement thereof.

12. The privacy fence of claim 11 wherein said actuator mechanism is operable to affect simultaneous vertical movement of all said post members when activated.

13. The privacy fence of claim 11 wherein said actuator mechanism includes a power source supported within the interior post cavity of a selected base post, and a cooperative actuator member positioned in the interior post cavity of the remaining base posts and connected to the lower portions of the corresponding post members, each said actuator member being operatively coupled to said power source.

14. The privacy fence of claim 13 wherein each said actuator member is an electrical actuator operatively connected to an electrical powerer to receive electrical power therefrom, said electrical powerer being operable remotely.

15. The privacy fence of claim 13 wherein each said actuator member is fluidly coupled to said power source.

16. The privacy fence of claim 11 wherein said base panel section is formed of vertically oriented slats, each said slat having an interior slat cavity, each corresponding panel member being formed of slat members with each said slat member being received in the interior slat cavity of a corresponding said slat, each said slat member of each respective said panel member being connected to a horizontal support member extending between the adjacent said post members so that said slat members will be vertically movable relative to said slats.

17. The privacy fence of claim 16 wherein the slats on each said base panel section are interconnected by a pair of vertically spaced horizontal supports interconnecting the adjacent base posts to support said slats therebetween.

18. The privacy fence of claim 11 wherein at least one of said post members is capped with a flower pot shaped to permit insertion into an open top post member surface.

* * * * *